US005630470A

United States Patent [19]

Lockwood, Jr.

[11] Patent Number: 5,630,470

[45] Date of Patent: May 20, 1997

[54] CERAMIC HEAT EXCHANGER SYSTEM

[75] Inventor: Hanford N. Lockwood, Jr., San Mateo, Calif.

[73] Assignee: Sonic Environmental Systems, Inc., Parsippany, N.J.

[21] Appl. No.: 422,097

[22] Filed: Apr. 14, 1995

[51] Int. Cl.[6] ..... F28F 9/04

[52] U.S. Cl. ..... 165/82; 165/178; 165/DIG. 52; 285/165

[58] Field of Search ..... 165/82, 134.1, 165/158, 178; 285/165, 189

[56] References Cited

U.S. PATENT DOCUMENTS

| | | | |
|---|---|---|---|
| 1,235,057 | 7/1917 | Roberson | 165/175 X |
| 3,263,747 | 8/1966 | McKay | 165/76 |
| 3,306,636 | 2/1967 | Hereth | 285/165 X |
| 3,353,848 | 11/1967 | Bleasby | 285/165 X |
| 3,504,739 | 4/1970 | Pearce | 165/134.1 |
| 3,923,314 | 12/1975 | Lawler et al. . | |
| 4,106,556 | 8/1978 | Heyn et al. . | |
| 4,122,894 | 10/1978 | Laws et al. . | |
| 4,332,295 | 6/1982 | LaHaye et al. | 165/178 |
| 4,360,057 | 11/1982 | Koump | 165/82 |
| 4,449,575 | 5/1984 | Laws et al. . | |
| 4,585,057 | 4/1986 | Marburger | 165/134.1 |
| 4,632,181 | 12/1986 | Graham . | |
| 5,035,283 | 7/1991 | Brucher et al. | 165/134.1 |
| 5,160,176 | 11/1992 | Gale | 285/165 |

FOREIGN PATENT DOCUMENTS

| | | |
|---|---|---|
| 191175 | 1/1923 | United Kingdom . |
| 2015146 | 9/1979 | United Kingdom . |

*Primary Examiner*—Allen J. Flanigan

*Attorney, Agent, or Firm*—Hopgood, Calimafde, Kalil & Judlowe, LLP

[57] ABSTRACT

Disclosed is a high temperature heat recovery system having a unique high temperature heat exchanger made of refractory and ceramic materials which can operate in gas streams of up to about 1,500° C.

28 Claims, 9 Drawing Sheets

CERAMIC HEAT EXCHANGER SYSTEM

BACKGROUND OF THE INVENTION

1. Field of Invention

The present invention relates to high temperature heat recovery systems. More particularly, the invention is a high temperature heat exchanger made of refractory and ceramic materials which can operate in gas streams of up to about 1,500° C.

2. Description of the Related Art

Furnaces for transferring heat to processed products at very high temperatures (such as for glass or metal smelting) result in stack gas temperatures at approximately the temperature of the furnace bed. In addition to fuel which must be added to the furnace to melt the product, fuel must also be added to heat the combustion air up to the average temperature in the furnace. Without some type of heat recovery system in the stacks, the energy associated with stack gases is lost when the gases are vented out of the system at furnace temperature. Heat exchangers are therefore routinely used to recover stack gas enthalpy by transferring this heat to the incoming combustion air.

However, the ultra high temperatures of operation create a highly erosive and destructive environment for most engineering materials including steel. There remains a need in the art for a heat exchanger capable of efficient operation at such elevated temperatures.

All metal heat exchangers are known such as disclosed in British Patent No. 191,175 issued to Walker, which describes a metal gas cooler having a double tube sheet design in which gas tubes are disposed between two walls of each tube sheet. Process gas is designed to pass through the tubes while cooling liquid passes over the outside of the tubes. The stated purpose of the two walls is to ensure that none of the cooling liquid comes in contact with the process gas. Such heat exchangers are temperature limited due to the all metal construction and are incapable of operating in hot gas streams above 850° C. for extended periods of time without inevitable tube failures.

Attempts have been made to develop designs for high temperature heat exchangers using tubes and tube sheets made of ceramics or refractories or a combination of like materials. Known ceramic heat exchangers have had limited success due to failures in three areas.

The first is in the tubes where complications occur due to oxidation or chemical deterioration of the ceramic materials which cause the tubes to break. Another mode of tube failure is a phenomenon known as thermal shock which happens if the ceramic tube is heated or cooled too quickly, above an acceptable rate.

The second area of failure is in the seal between the tube and the tube sheet. Currently available ceramic heat exchangers have ceramic fiber materials which form a seal between the outside surface of the tube and the inside surface of the tube sheet. In some cases the tube end is also designed to press against a ceramic fiber ring which in turn is held in a relief cut into the tube opening in the tube sheet. When such ceramic heat exchangers are cycled between hot and cold conditions, the tubes and tube sheets expand and contract. Expansion of the tube compresses or deforms the ceramic fiber seal which has no memory of its original shape. After a few cycles, the seal material rapidly disintegrates into powder which blows out of the seal area.

Some ceramic fiber materials can also melt in the seal at extreme temperatures or after chemical exposure from the process. During the next cold cycle, as the tube contracts and pulls back from the seal, the molten seal material fills the resulting void and hardens. When these types of ceramic heat exchangers are brought back up to operating temperature, the tube expands before the deformed seal material can melt out of the way. This causes the tube to fail or makes the tube push the tube sheet out of position resulting in tube sheet leaks.

The third failure mode comes from conventional tube sheet designs, the most common of which require refractory blocks or ceramic tiles stacked one above the other to form the tube sheet. In some designs there are interlocking notches or grooves which have alignment keys or ceramic fiber material to seal the joints between adjacent blocks or tiles. Such tube sheets expand and contract with the hot and cold temperature cycles of the process with differential expansion from the hot side to the cold side as the tubes absorb the heat from the process stream.

For example, if the process flow enters such heat exchangers at the bottom of the tube sheet at 1,400° C., it can exit the heat exchanger from the top of the tube sheet at 1,200° C., causing a reduced rate of thermal expansion at the top of the tube sheet relative to the bottom. This differential expansion can break the bonds between the tiles making up the tube sheet and cause misalignment between the tube sheets of the ceramic heat exchanger which in turn can bind or break the tubes.

Problems also exist in the Joints and seams which hold together the refractory blocks or ceramic tiles. The joints and seams usually have a binder to hold the tiles in place. The problem is that tubes are much stronger than currently known binder material design. When tube seals melt or degrade, the expanding tubes can push against the tube sheet and break the tile binder which will destroy the tube sheet integrity and cause it to leak.

Leaks can also be caused by eutectic formations on the hot gas side of tube sheets made of refractory blocks or ceramic tiles. Vaporized chemicals in the hot gas can attack the tube side surface of the tube sheet and cause a reduction in the melting temperature of the refractory block or ceramic tile surfaces. At hot operating temperatures, the surface of such tube sheets can melt, and this molten material from the surface can enter cracks which develop in the binder between the tiles. At the next cool down cycle, the molten material within the cracks solidifies and the tube sheet is unable to return to its original shape. Over time this will distort the tube sheet and cause tube misalignment resulting in tube bindings and breaks.

Attempts at developing a high temperature ceramic heat exchanger have been published. For instance, U.S. Pat. No. 4,632,181 issued to Graham describes a ceramic heat exchanger of a tube and shell design with a tube sheet made from a series of stacked tiles. The Graham patent is typical of the state of the art, it describes tubes, tube seals and tube sheet walls which suffer weaknesses as discussed above.

U.S. Pat. No. 4,449,575 issued to Laws describes a heat transfer system in which ceramic tubes are mounted in a fluid bed reactor furnace. However, the Laws design requires a metal locking means for compressing a fibrous ceramic seal against the ceramic tube which limits it to operating temperatures below 900° C. The ceramic fiber seals also degrade over time and expanding tubes cause a permanent deflection of the packing as described above.

British Patent Application No. GB2015146A by Laws describes a tube and shell heat exchanger having ceramic tubes mounted into a wall made from parallel elongated ceramic tube blocks held in place by metal bolts. The metal bolts limit this system to operating temperatures below 900° C., and the walls held by the bolts develop leaks through the seams which expand with ash buildup over time.

U.S. Pat. No. 4,122,894 issued to Laws et al. describes another conventional ceramic tube and shell heat exchanger having a tapered tube opening in the tube sheet into which different diameter packing rings concentric with the tube can be inserted. This design also requires a ceramic fiber seal which tightly restrains the tube and which are prone to leakage as the tube expands into the tube sheet, as noted above.

U.S. Pat. No. 4,106,556 issued to Heym et al. describes a ceramic heat exchanger system where two tube sheets are mounted one above the other on the same (top) side of a hot gas duct. The Heym tube sheets must have metal plates on surfaces exposed to the process gas and all tubes are held in their respective tube sheets with metal lock rings which, again, limits the design to operating temperatures below 900° C.

U.S. Pat. No. 3,923,314 issued to Lawlet et al. describes a heat exchanger made of silicon carbide tubes mounted in a silicon carbide tube sheet. The silicon carbide exchanger is specifically designed for heating aqueous, highly corrosive, acid streams at about 205° C. and is not suitable for high temperature heat exchange.

There is a need in the art for a practical design which corrects the deficiencies hereinabove noted and allows a heat exchanger to operate at very high temperatures without tube, tube seal or tube sheet failures. Currently available ceramic heat exchangers have tube and tube sheet seal problems due to a lack of freedom in physical mobility which this disclosure identifies as a requirement to protect the system against large thermal expansions and contractions experienced during operation cycles between low and high temperature operation.

SUMMARY OF THE INVENTION

The present invention is a tube and shell type heat exchanger which takes advantage of the high temperature characteristics of ceramics and refractory materials but at the same time provides allowances for their limitations.

The new heat exchanger consists of a rigid refractory lined shell with tube sheets at both ends. Between the respective tube sheets, ceramic heat exchanger tubes are mounted with a slip fit into the seal assemblies on the tube sheet. The ceramic heat exchanger tubes have a textured or extended external and internal surfaces. The gap between the ball seal and the curved cavity in the tiles is filled with ceramic fiber to form a seal and to act as a cushion for the ball seal. Ceramic fiber material also forms a gasket which prevents gas from leaking between the two tube sheet tiles.

The seal assemblies are designed to allow tube expansion and contraction to be absorbed without displacing the rigid tube sheet. This ability to allow free expansion or contraction of the tube is required because even the tubes within a single heat exchanger pass will have different temperatures from the top to the bottom of the tube sheet. Accordingly, the seal assemblies of the present invention allow for both axial tube expansion and contraction as well as angular freedom of motion to prevent the development of a moment force on the ceramic heat exchanger tubes. Such seal assembly means allows for heat exchanger operation in the temperature range of about 900° C. to about 1600° C., with heat transfer achieved by a combination of thermal convection and radiation.

Incorporated into the new seal assembly design is the ball seal system. The ball seal is mounted in the tube sheet and allows an angular freedom of motion for the ceramic tube. Known metal heat exchanger designs have rigid tube attachment points in the tube sheet wall which can only absorb angular tube deflections through bending of the tubes. Unlike metal tubes, known ceramic tubes will fracture if they are forced to bend beyond the allowable stress levels of the material.

An important feature of the ball seal of the present invention is that its radius of curvature is determined from the centerline of the ceramic tube in two planes in order to achieve the angular freedom of movement required. The ball seal, mounted in each tube sheet at each end of the tube, must be able to absorb the full thermal expansion or contraction of the tube in case the tube takes up all of its movement at one end only. The new ball seal with its angular freedom of motion solves the problem that results in many of the tube failures found in presently known designs.

Another innovation in the new ceramic heat exchanger design is in the location and design of the fiber ceramic seals. The ball seal is mounted in the tube sheet by two tile pieces. One of the tile pieces is the tube side tile, and the other is the process side tile. These two tiles are joined in the middle of the tube sheet by threads or a bayonet mount. At the junction of the two tile pieces, there is a curved surface which has a slightly larger radius in two planes than the radius of the ball seal.

Thus, two tile pieces are joined at a junction which has a curved surface having a radius in the transverse plane which is greater than the radius of the ball seal, and a radius in the longitudinal plane which is also greater than the radius of the ball seal. Furthermore, each radius is formed at an offset to cause the longitudinal curve of the two tile pieces to approach the surface of the ball seal at each end of the curved surface of the junction.

A further innovation of the new ceramic heat exchanger is in the tube sheet structure. In order to prevent the problems associated with tube sheets made of refractory blocks or ceramic tiles which are deflected by tube expansion or accumulation of ash deposits in the seams, the presently disclosed ceramic heat exchanger has a gas cooled stainless steel double wall with refractory on both sides. This wall is exceptionally rigid and strong because the two parallel metal wall plates are joined by a hollow spacing means, preferably a short piece of stainless steel tubing welded to both plates and concentric to the centerline of each ceramic tube location. This makes the two metal wall plates very stiff and makes the tube sheet very strong. On both sides of the double metal plates are castable insulating refractory which protects the inner stainless steel wall structure.

The tube side tiles and the process side tiles each have a flange on the outside end which overlaps the castable insulating material causing the tile pieces to act as refractory anchors. Depending on the differential temperature between the gas on the process side and the hot gas stream, the thickness of the insulating refractory on both sides of the double metal wall can be adjusted to achieve an equal temperature on both sides of the double metal wall. This eliminates stresses on the metal wall structure due to differential temperatures across the tube sheet.

The space between the double metal walls of each tube sheet is used as a cooling duct. Cooling gas is pumped into the duct where it carries off excess heat which flows from both sides of the tube sheet to the center double metal walls. This cooling system allows the process gas on one side of the tube sheet and the hot gas on the other side of the tube sheet to be at much higher temperatures than the metal structural wall in the center of the tube sheet. Under operating conditions the hot gas can be at about 1,500° C. and the process gas can be at about 1,000° C., while the double metal wall can be maintained between about 700° and about 800° C.

The wall cooling gas can be either ambient air at about 25° C. blown into the wall cooling duct, or steam. Steam at about 100° to about 150° C. is an excellent coolant because it has a specific heat which is almost twice the specific heat of ambient air. One or more thermocouples can be installed in the double metal wall which can be used to indicate the temperature in the wall while the unit is operating. The output from the thermocouple can also be used as input to an over-temperature alarm, a limit switch which can shut down the process if the tube sheet is overheated, or can provide temperature indication to a temperature control loop which can be used to maintain a preset temperature in the ceramic heat exchanger tube sheet.

The new ceramic heat exchanger is made up of modules which consist of several different models depending on the number of tubes and the tube layout in the tube sheet. Depending on the application requirements, two or more exchanger modules can be applied in series (forming different passes) or parallel (forming a single pass) or a combination of both series and parallel arrangements for larger heat exchanger applications. Each module has its own tube sheet cooling system to insure that the tube sheet at each end of the module is within allowable temperature limits.

A system suitable for the present invention can consist of a high temperature furnace in which the exhaust gas temperature is between about 800° to about 1,600° C. The primary furnace of this system should be part of a process which will accept preheat of the combustion gas in the furnace. The ceramic heat exchanger described herein is mounted in the exhaust duct from the furnace and is designed to lower the exhaust gas temperature by recovering the heat. The exhaust gas passes through the heat exchanger shell and over the outside of the tubes. Simultaneously, a fan draws in ambient air which passes through the tubes of the heat exchanger on the way to the furnace burners. The air starts at ambient temperature as it enters the ceramic heat exchanger tubes and increases in temperature until it exits the heat exchanger about 400° and about 1,100° C. The preheated combustion air is sent to the furnace burners where fuel is added and burned. The heat contained in the combustion air reduces the fuel consumption by the amount of fuel necessary to heat the combustion air from ambient temperature to the temperature at the exit of the last pass of tubes in the heat exchanger. The fuel savings in some cases can be as high as 50 percent because of the exceptionally high temperature rating of this new ceramic heat exchanger design.

A unique feature of this heat recovery process is the special cooling system for the double walls of the tube sheet. The cooling air which is absorbing heat from within each tube sheet can be vented to the process gas inlet where the heat from the tube sheets can be recovered by the process.

This invention describes the development of a new type of high temperature ceramic heat exchanger which overcomes the weaknesses of prior designs. The improvements contained herein enable the present heat exchanger to operate at the limits of currently available materials and increases the potential applications of heat recovery technology.

BRIEF DESCRIPTION OF THE DRAWINGS

The unique advantages of the present invention will become apparent to one skilled in the art upon reading the following specification and by reference to the drawings in which.

DETAILED DESCRIPTION OF THE INVENTION

Figure 1:
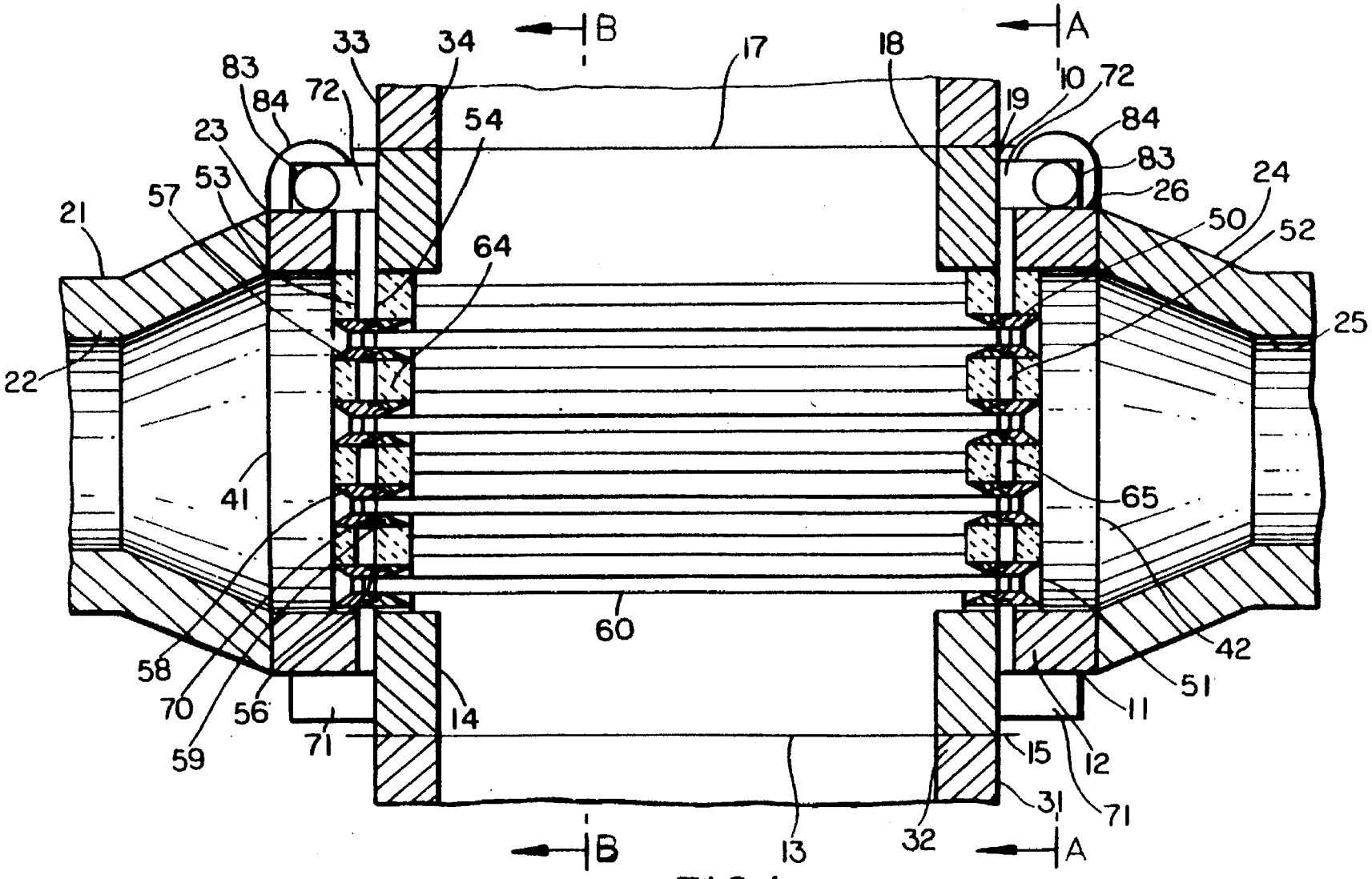
FIG. 1 is a vertical cross-section through the vertical centerline of the ceramic heat exchanger.
Figure 3:
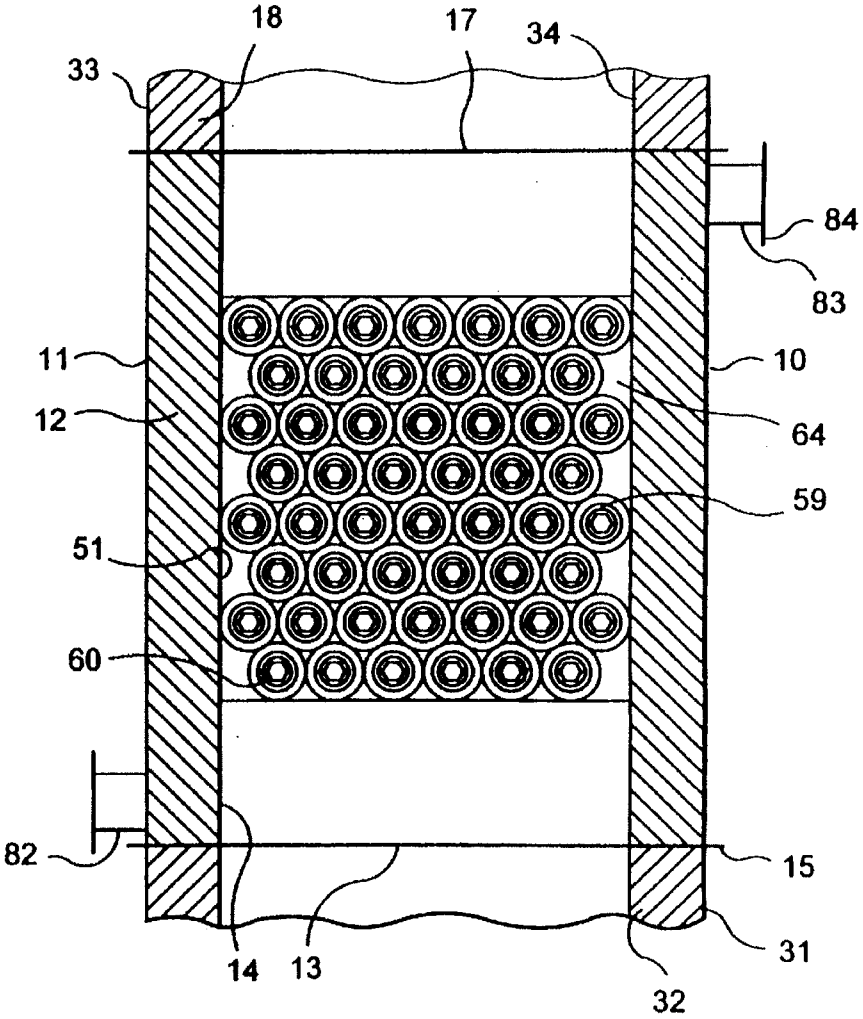
FIG. 3 is a vertical cross-section through the ceramic heat exchanger along section B—B of FIG. 1.
Figure 2:
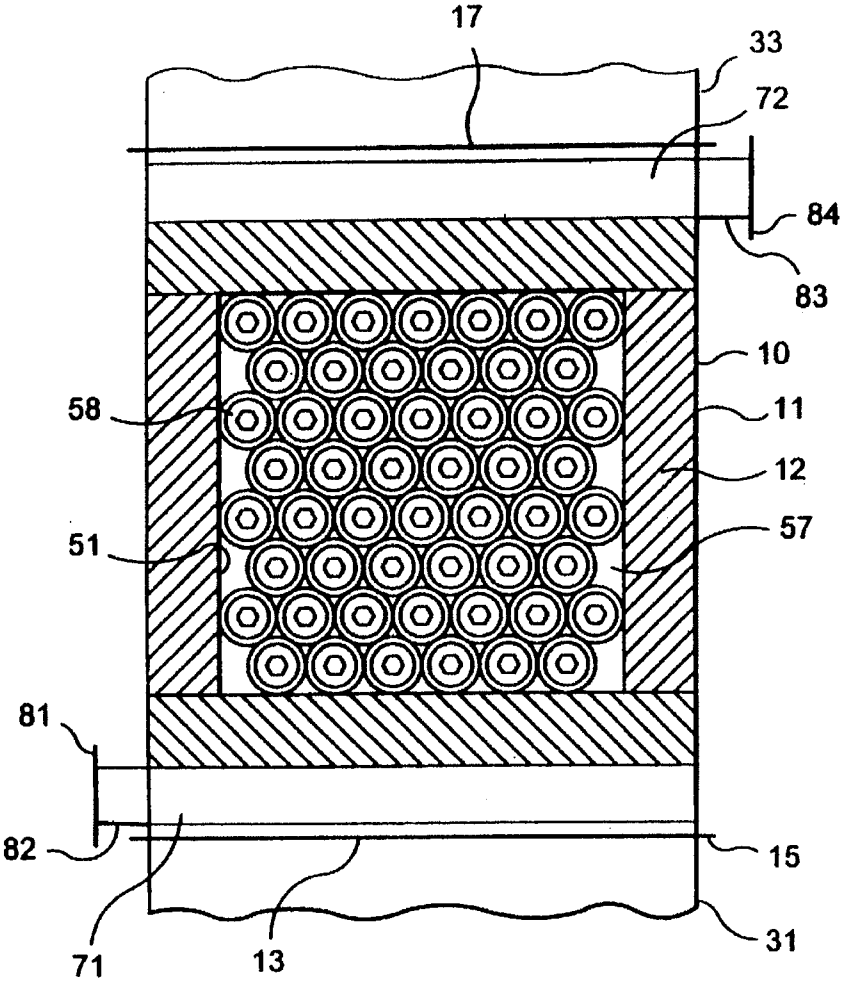
FIG. 2 is a vertical cross-section through the ceramic heat exchanger along section A—A of FIG. 1.

The design of this invention for the high temperature heat recovery system is best shown in the attached drawings. FIG. 1 shows a vertical sectional view of the high temperature ceramic heat exchanger 10 which is a key part of the heat recovery system. FIG. 2 and FIG. 3 show sections taken through the ceramic heat exchanger at the A—A section line and the B—B section line. The ceramic heat exchanger 10 consists of a metal shell 11 which is lined with a high temperature refractory liner 12. The refractory liner 12 is designed with adequate insulation qualities, so that the external metal temperature of the ceramic heat exchanger 10 is in the range of 50° to 120° C.

On the bottom of the metal shell is a hot gas inlet 13 which also has a refractory lining 14 and is directly attached to a source of hot gas through a metal duct 31 which also has a refractory lining 32 by the hot gas inlet flange 15. At the top of the metal shell 11 on the side opposite the hot gas inlet 13 is the hot gas outlet 17 which also has a refractory lining 18. The hot gas outlet 17 has a connecting duct 33 which has a refractory lining 34 and connects to the hot gas outlet 17 at flange 19. The hot gas outlet duct 17 takes the hot gas to another pass of the ceramic heat exchanger or on to some type of gas cleaning system prior to venting the gas to the environment. The hot gas inlet 13 and the hot gas outlet 17 can be in the vertical orientation shown in FIG. 1 or can have a horizontal orientation which is not shown.

Attached to the ceramic heat exchanger metal shell 11 is the process gas inlet duct 21 which may have a refractory lining 22 if the process gas is hot or may not have a refractory lining in the event that the process gas is at ambient temperature. The process gas inlet duct 21 is attached to the metal shell 11 at a flange 23. At the opposite end of the ceramic heat exchanger metal shell 11 is the process gas outlet duct 24 which has a refractory lining 25 and is attached to the ceramic heat exchanger metal shell 11 at flange 26.

At both the process gas inlet 41 and process gas outlet 42 to the ceramic heat exchanger and rigidly attached to the metal shell 11 are the inlet tube sheet assemblies 51. The details of the attachment of the tube sheets to the metal shell will be described in detail later. The tube sheet assembly 51 as shown in detail in FIG. 4 consists of the inner metal structure 52 composed of the process side plate 53 and the hot side plate 54 which are parallel stainless steel plates separated by spacer tubes 56 which are concentric to the centerline of the ceramic heat exchanger tubes 60. The process side of the tube sheet assembly 51 has an insulating castable refractory 57 which is cast over the outside surface of the process side plate 53. The castable refractory is a Harbison-Walker Refractories Lightweight Castable 33 or equal and is capable of a maximum service temperature of 1,815° C. On the process side of the tube sheet assembly 51 and concentric to each ceramic tube 60 centerline is the process side tile 58 which has a male thread 61 that engages the hot gas side tile 59 through a female thread 62.

On the hot gas side of each tube sheet assembly 51, there is an insulating castable refractory 64 which has similar specifications to the insulating castable refractory 57 on the process side of the tube sheet assembly 51. Also concentric to each ceramic heat exchanger tube 60 centerline is a hot gas side tile 59. The process side tile 58 and the hot gas side tile 59 have ceramic fiber gaskets 40 at beth ends of the ceramic thread assembly to act as a gas tight seal. The process side tile 58 and the hot gas side tile 59 are made of silicon carbide ceramic materials or their equivalent. Between the process side tile 58 and the hot gas tile 59 and concentric to the centerline of the ceramic heat exchanger tube centerline is the ball seal 70. The ball seal 70 has a stepped hole 43 through it on centerline with the larger diameter 44 facing the hot gas side of the tube sheet assembly. The larger diameter 44 is slightly larger than the outside diameter 75 of the ceramic heat exchanger tube 60 allowing the ceramic heat exchanger tube 60 to freely move in the ball seal.

An important feature of the design of the new ceramic heat exchanger 10 is the rigid attachment of the tube sheet assemblies 51 to the metal shell. As the hot gas heats up during startup, the refractory line 12 will heat up and insulate the metal shell 10 from most of the heat, but eventually the metal shell will see a temperature between 50° to 120° C. and will expand slightly. This expansion will increase the distance between the tube sheet assemblies 51 by 1.5 to 4.0 millimeters, if the tube sheet assemblies are approximately 2 meters apart. This makes the external dimensions very stable and means that some other system must be used to take up the differential expansion expected from the hot ceramic tubes 60.

Between the two tube sheet assemblies 51 there are a number of ceramic tubes 60 which transfer the heat from the hot gas side to the process side. The ceramic tubes can be made from chemical resistant ceramic materials depending on the application of the ceramic heat exchanger 10. In a typical air to air heat transfer application, the tubes must be made of an oxidation resistant ceramic such as Silicon Carbide Particulate Reinforced Alumina ($SiC_p/Al_2O_3$) which is made by DuPont Lanxide Composites, Inc. or its equivalent. As the temperature in the ceramic heat exchanger 10 increases during startup, these ceramic heat exchanger tubes 60 will expand and increase in length from 10 to 30 millimeters. The differential expansion between the heat exchanger metal shell and the ceramic heat exchanger tubes 60 at full temperature is taken up by the slip fit between the outside diameter 75 of the ceramic tube 60 and the larger diameter 44 of the ball seal 70 at each heat exchanger tubes 60 location in the tube sheet assemblies 51. The expansion of the ceramic tubes 60 can vary within a single tube bundle.

Figure 4:
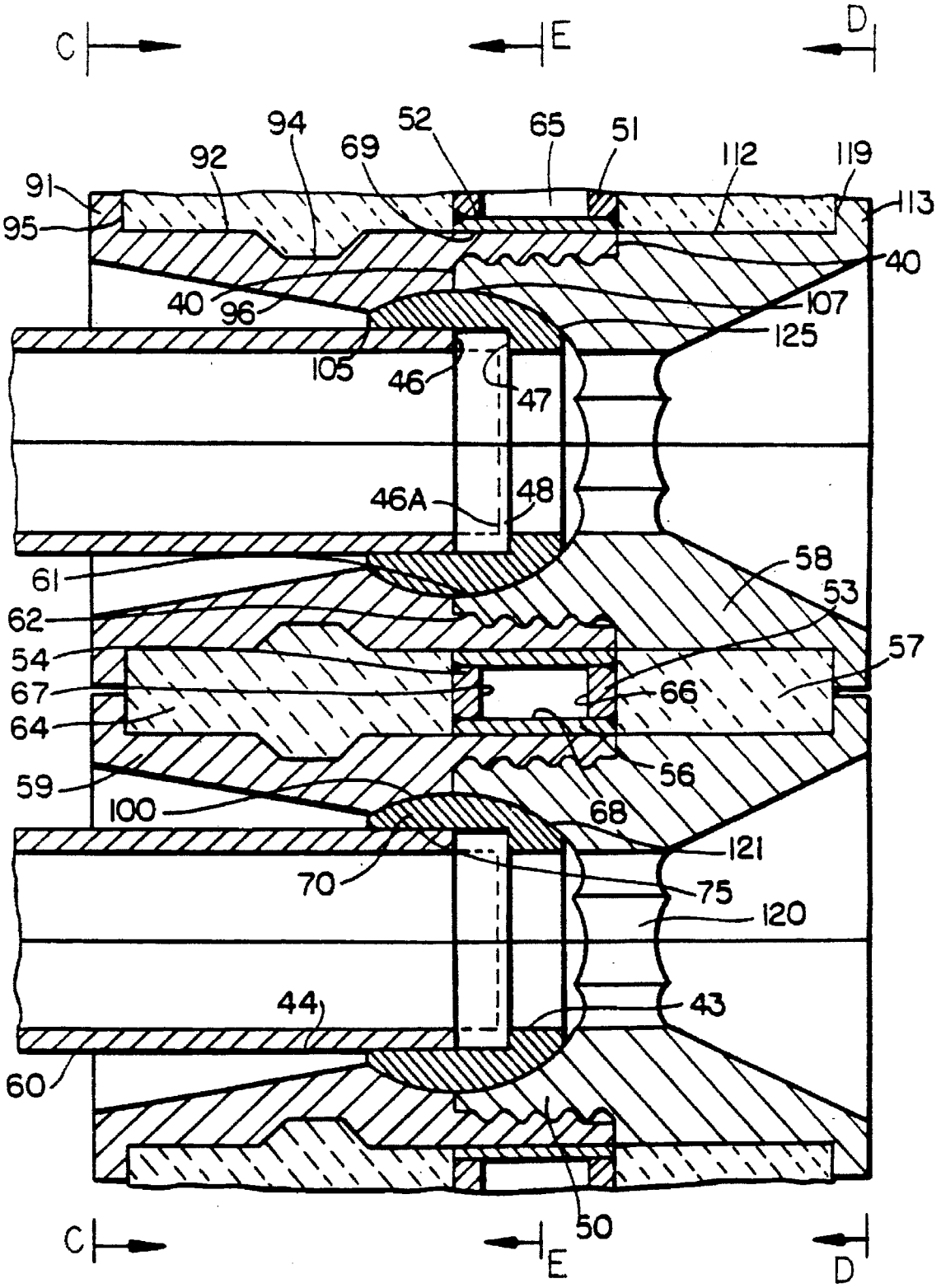
FIG. 4 is a sectional detail showing the tube termination details for two adjacent tubes.

In FIG. 4 the ceramic tube 60 is shown in its cold position with the ceramic tube end 46 separated from the step 47 in the ball seal 70 bore 43. As the ceramic heat exchanger 10 temperature increases, the ceramic tube 60 expands. Its length increases until the ceramic tube end 46 moves to its hot position 46A. Even in the hot position 46A, there is still a small gap 48 which prevents the ceramic tube 60 from applying any force to the tube sheet assembly 51.

Each tube sheet assembly 51 has a cooling duct 65 defined by the inside surface 66 of the process side plate 53, the inside surface 67 of the hot gas side plate 54, and the external surface 68 of the spacer tubes 56. This cooling duct 65 is used to pass a cooling gas through each tube sheet to carry away excess heat that is transferred through the process side castable refractory 57 or the hot gas side castable refractory 64. The cooling gas may be air, steam or any other type of gas fluid coolant.

The tube sheet coolant enters the tube sheet cooling duct 65 through an inlet duct (not shown) attached to flange 81 and through inlet pipe 82 to manifold 71. The coolant passes over the outside surface 68 of the spacer tubes 56 and picks up heat from the inside surface 66 of the process side plate 53 and inside surface 67 of the hot gas side plate 54. The coolant is collected at the cooling duct outlet manifold 72 where it is ducted through the exit pipe 83 attached to the exit duct (not shown) at flange 84 as it exits from the ceramic heat exchanger 10. The coolant is used to remove heat from the inner metal structure 52 in the tube sheet.

Figure 6:
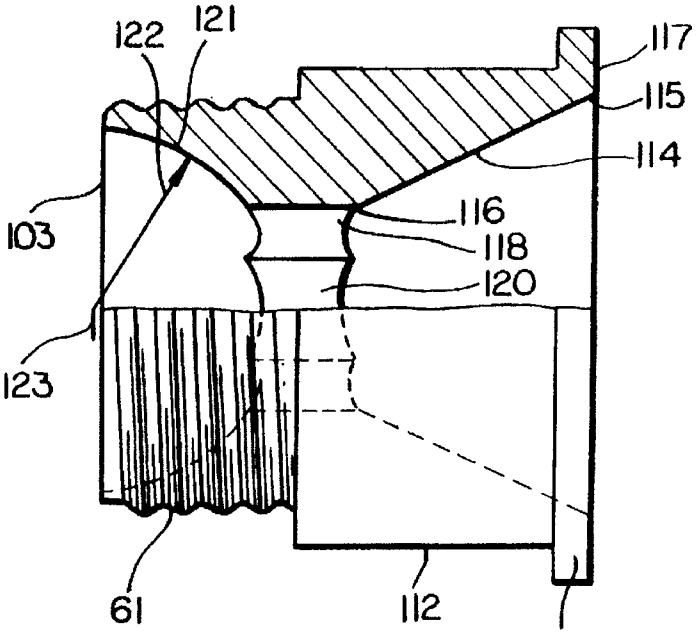
FIG. 6 is a sectional detail of the process side ceramic tile.
Figure 5:
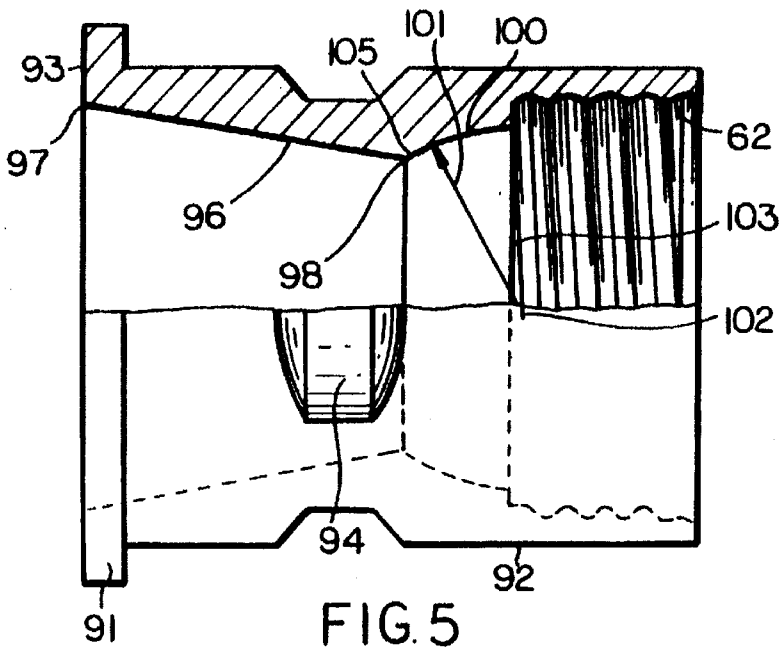
FIG. 5 is a sectional detail of the tube side ceramic tile.
Figure 7:
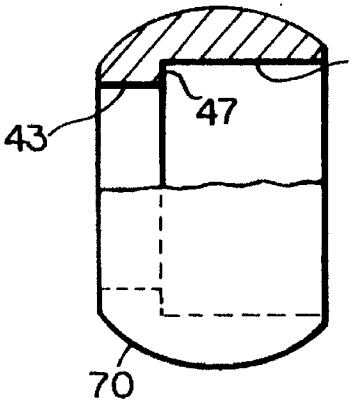
FIG. 7 is a sectional detail of the ball seal.

The ceramic heat exchanger 10 tube sheet assemblies 51 are composite structures as shown in FIG. 4 with specific components shown in FIGS. 5, 6 and 7. The tube sheet assembly 51 is structurally built around the inner metal structure 52. On the hot gas side of each ceramic tube 60 seal assembly 50, there is the hot gas side tile 59 embedded in the insulating castable refractory 64. The hot gas side tile 59 has a flange 91 which acts as a refractory anchor to retain the castable refractory 64 in place. Between the flange 91 and the castable refractory 64, there is a ceramic fiber gasket 95 which achieves a gas tight seal. The outside cylindrical surface 92 of the hot gas side tile 59 is held in alignment by the inside surface 69 of the spacer tube 56. As the castable refractory 64 is cast over the hot side plate 54 of the inner metal structure 52, it bonds to the outside surface 92 and fills four flats 94 cast into the outside surface 92 of the hot gas tile 59. The four flats 94 assist in holding the castable refractory 64 in place and bind hot gas tile 59 to the castable refractory to prevent the hot gas side tile 59 from turning when the process side tile 58 is threaded into the female thread 62 of the hot gas side tile 59.

The hot gas tile 59 has a conical surface 96 with its large diameter 97 at the hot face 93 and its small diameter 98 at the hot side ball seal socket 100. The conical surface 96 is concentric to the centerline of the ceramic tube 60 and provides clearance, so that the ceramic tube 60 can absorb angular deflection in the event that the the fatal expansion rate is different between adjacent ceramic heat exchanger 10 tube sheet assemblies 51. The hot gas side tile 59 ball seal socket 100 is also designed with a radius 101 offset 102 from the ball seal socket 100 centerline 103. The offset 102 reduces the clearance between the ball seal socket 100 and the ball seal 70 to a minimum at the ball seal socket 100 edge 105. The reduced clearance at the edge 105 is designed to retain a ceramic fiber gasket 107 which is installed between the ball seal socket 100 and the ball seal 70 over many heating and cooling cycles of the ceramic heat exchanger 10.

On the process side of the tube sheet assembly 51, at each ceramic tube 60 seal assembly 50, there is a process side tile 58 which is embedded in the insulating castable refractory 57. The process side tile 58 has an outside cylindrical surface 112 which is free to move in the insulating castable refractory 56. A flange 113 is cast into the process side tile 58 to act as a refractory anchor for the insulating castable refractory 57. Between the flange 113 and the castable refractory 56, there is a ceramic fiber gasket 119 which achieves a gas tight seal. The castable refractory 56 is installed on the process side of the inner metal structure 52 before the process side tile 58 is installed.

The process side tile 58 has a conical surface 114 with its large diameter 115 at the hot face 117 and its small diameter 116 at the process end 118 of the hexagonal shaped bore 120. The hexagonal shaped bore 120 is designed to accept a hexagonal driver (not shown) intended to enable the process side tile 58 to be installed in the tube sheet assembly 51 by engaging the male thread 61 into the female thread 62 in the hot gas side tile 59. The conical surface 114 and the hexagonal shaped bore 120 are concentric to the centerline of the seal assembly 50. The hexagonal shaped bore 120 ends in the process side ball seal socket 121. The ball seal socket 121 is also designed with a radius 122 offset 123 from the ball seal socket 121 centerline 103. This offset 123 reduces the clearance between the ball seal socket 121 and the ball seal 70 to a minimum at the ball seal socket 121 edge 125. The reduced clearance at edge 125 is designed to retain a ceramic fiber gasket 107 which is installed between the ball seal socket 121 and the ball seal 70.

The hot gas side of the tube sheet assembly 51 is usually 200° to 300° C. above the temperature on the process gas side of the tube sheet assembly 51. At the same time the temperature at the inner metal structure 52 of the tube sheet assembly can be 100° to 200° C. below the temperature on the process gas side of the tube sheet assembly 51. Since the inner metal structure 52 is made up of parallel stainless plates, it is desirable to keep both the process side plate 53 and the hot side plate 54 at the same temperature to prevent the development of thermal stresses which might cause the inner metal structure 52 to bend. This can be achieved by adjusting the thickness of the castable refractory 64 on the hot side in relation to the thickness of the castable refractory 57 on the process side of the tube sheet assembly 51. As an example if the hot gas temperature is 1,400° C. and the process gas temperature is 1,200° C. with a design temperature of 800° C. on the inner metal structure 52, the ratio of castable thickness can be determined from temperature ratios. The hot gas temperature minus the inner metal structure 52 temperature is 600° C. while the process gas temperature minus the inner metal structure 51 temperature is 400° C. The 600° C. hot side differential is 1.5 times the process side differential, so the hot side castable refractory 64 should be 1.5 times the thickness of the process side castable refractory 57. This will equalize the temperature on both sides of the inner metal structure 52 and prevent any bending of the tube sheet assembly.

The hot side ball seal socket 100 and the process side ball seal socket 121 are designed to capture and retain the ball seal 70 when the hot gas side tile 59 and the process side tile 58 are assembled into the tube sheet assembly 51. The ball seal 70 is designed to provide slip fit with the end of the ceramic tube 60. For ceramic heat exchangers 10 where higher rates of gas leakage between the hot side and process side is acceptable, the ball seal 70 can have a larger diameter 44 designed to accept the largest outside diameter of the ceramic tile 60 as specified by the ceramic tube 60 manufacturer. This means that the maximum clearance between the ball seal 70 larger diameter 44 and the ceramic tube 60 with a minimum acceptable diameter (within allowable tolerances) will establish the leakage rate of the ceramic heat exchanger 10. This could result in a clearance between the ball seal 70 and the outside diameter of the ceramic tube 60 that could be as high as 2 to 3 millimeters which can result in leakage rates from 7 to 10 percent.

In ceramic heat exchangers 10 where minimal leakage between the process side and the hot side is acceptable, the ceramic tube 60 can be machined to a predictable outside diameter. At the same time, the larger diameter 44 of the ball seal 70 can be machined to a diameter which is 0.25 to 0.30 millimeters greater than the outside diameter of the ceramic tube 60. This small clearance combined with the friction losses between the machined surface 75 of the ceramic tube 60 and the larger diameter 44 of the ball seal 70 can achieve leakage rates below one percent depending on the differential pressure between the process side and the hot gas side of the ceramic heat exchanger 10.

The ball seal 70 is the end support for the ceramic tube 60, so it must be designed to absorb the differential expansion caused by heating up the ceramic tube. The expansion can be different for different ceramic tubes 60 within the same tube sheet assembly 51. As an example, the ceramic tubes 60 at the point where the hot gas comes into initial contact with the ceramic heat exchanger 10 will be at higher temperatures than the ceramic tubes 60 at the point where the hot gas leaves the ceramic heat exchanger 10. This means that the ceramic tubes 60 that come into contact with the hot gas could grow up to 2 to 8 millimeters larger than the ceramic tubes on the cooler side of the ceramic heat exchanger 10.

The ball seal 70 must absorb the expansion as well as support the ceramic tube 60. Also the ceramic tube 60 may expand equally at both ends or it may remain fixed at one end while all the expansion is absorbed by the ball seal 70 at the other end. As a result, the larger diameter 44 of the ball seal 70 must have a length which is at least 1.6 to 1.8 times the total thermal expansion expected for the hottest ceramic tube 60 in the ceramic heat exchanger. This will prevent a cooled ceramic tube 60 from pulling free of the ball seal 70.

The ball seal 70 also has a ball seal bore 43 which is equal to the inside diameter of the ceramic tube 60. The ball seal bore 43 combined with the ball seal bore step 47 form a stop to hold the ceramic tube 60 in place. The ball seal bore 43 must be long enough to provide a stop of adequate strength. The length of the larger diameter 44, the ball seal bore 43, and the ceramic tube 60 diameter establish the minimum diameter of the ball seal 70. The ball seal 70 radius in two planes must be calculated from the center of the ceramic tube 60 to perform properly.

The ceramic heat exchanger 10 described in this application has the feature that any ceramic tube 60 in the tube sheet assembly can be changed without removing the adjacent ceramic tubes 60 when the ceramic heat exchanger 10 is cold. If a ceramic tube 60 is damaged, it can be removed by taking a hexagonal driver (not shown) and positioning it in the hexagonal shaped bore 120 in the process side tile 58. Using the hexagonal driver the process side tile 58 is unthreaded from the hot gas side tile 59 and removed from one of the two tube sheet assemblies 51. Then a metal rod or tube (not shown) is passed through the damaged ceramic tube 60 until it exits from the tube sheet assembly 51 at the opposite end of the damaged ceramic tube 60. The ball seal 70 and the damaged ceramic tube 60 can then be removed by sliding along the inserted metal rod or tube. Then the replacement ceramic tube 60 is inserted by pushing it over the metal rod or tube until it slides into the larger diameter 44 of the ball seal 70 of the opposite tube sheet assembly 51. Then the ball seal 70 is reinstalled in the ball seal socket 100 in the hot gas side tile 59 and slipped over the machined diameter 75 of the ceramic tube 60. The inserted metal rod or tube is removed and then the process side tile is reinstalled in the tube sheet assembly by engaging the male thread 61 into the female thread 62 in the hot gas side tile 59 using the hexagonal driver.

Figure 8:
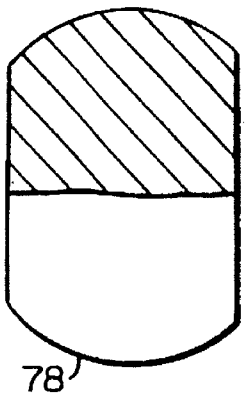
FIG. 8. is a sectional detail of the ball seal plug used to replace a broken tube.

In the event a spare ceramic tube 60 is not available, the ball seal 70 with its bore 43 can be replaced with a solid ball seal 78 shown in FIG. 8 at each end of the failed ceramic tube 60. This forms a gas tight repair in both tube sheet assemblies 51 and allows the ceramic heat exchanger 10 to be put back on line. The solid ball seals 78 can then be replaced by a new ceramic tube 60 and the two ball seals 70 at the next scheduled maintenance period. The ceramic heat exchanger 10 can operate with some of its ceramic tubes removed and plugged; however, the heat transfer efficiency is reduced.

Figure 9:
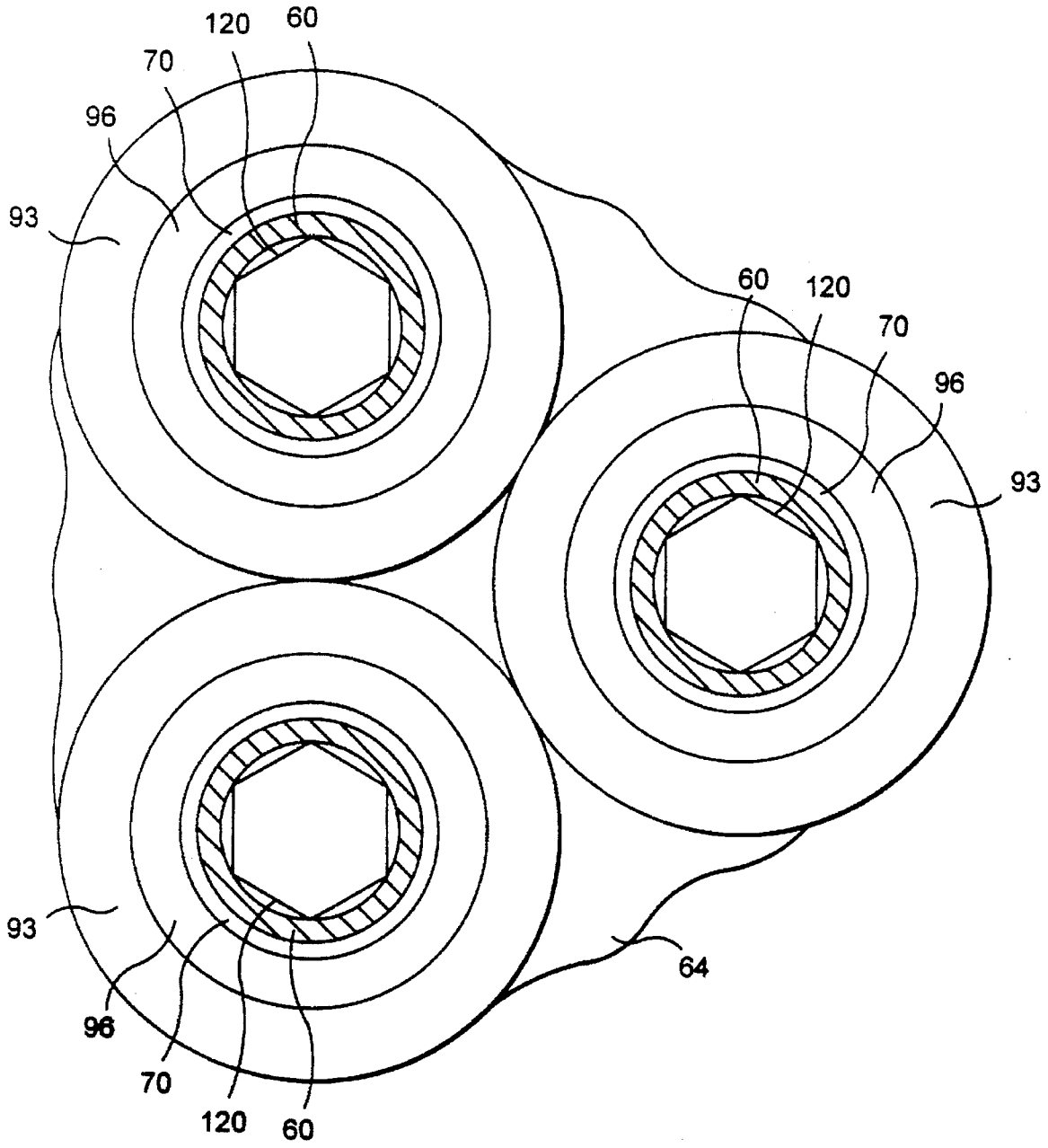
FIG. 9 is a partial sectional view along section C—C of FIG. 4.
Figure 10:
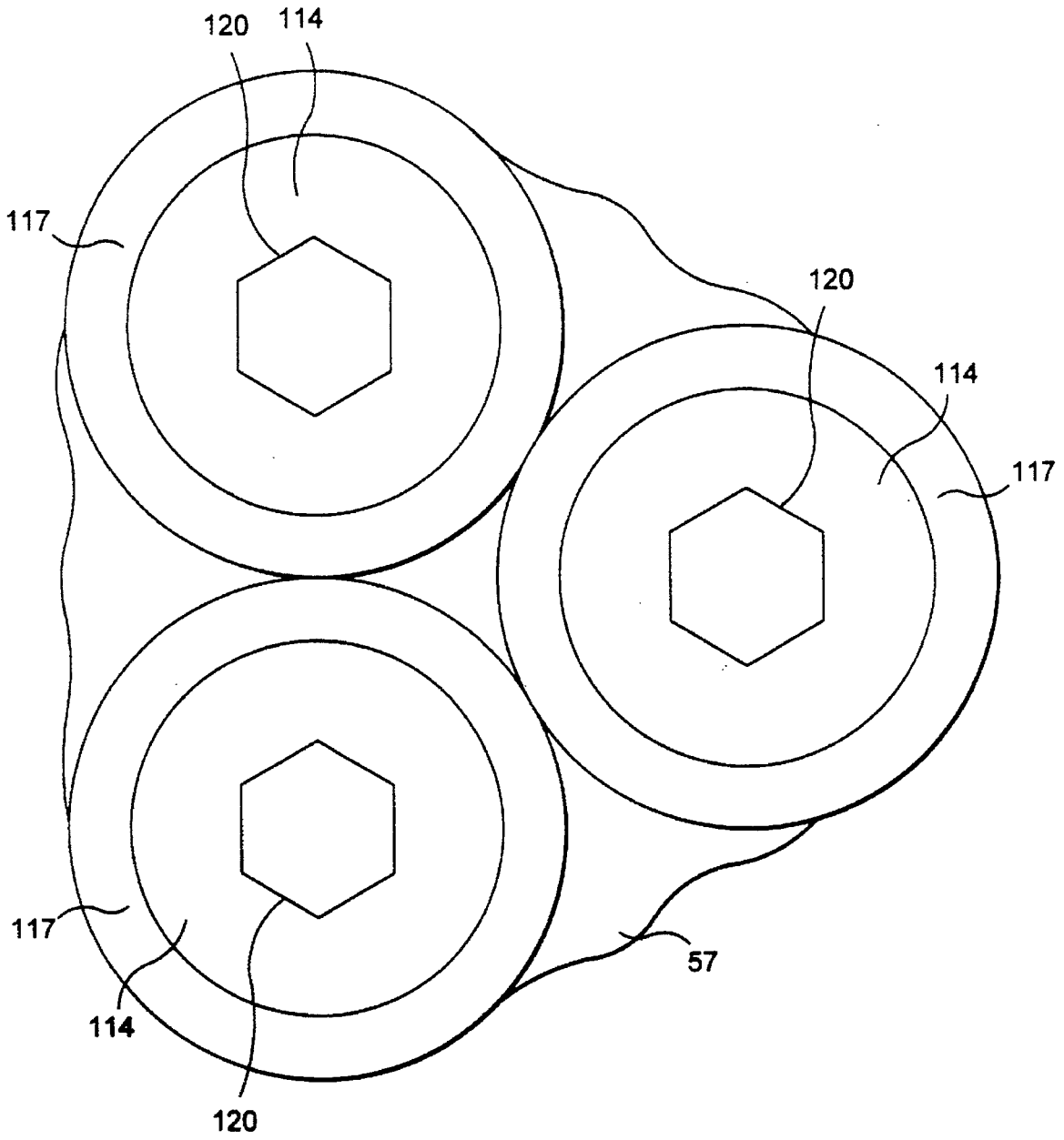
FIG. 10 is a partial sectional view along section D—D of FIG. 4.

FIG. 9 shows the hot side view of three ceramic tubes 60 and ball seal assemblies 50 and FIG. 10 shows the process side view of the tube sheet assembly 51 with three process side tile 58 locations. Unlike the prior art, the ceramic heat exchanger 10 described herein can have any arrangement of ceramic tubes 60 in the tube sheet assembly. FIG. 9 and FIG. 10 show the most compact arrangement where adjacent ceramic tubes are equidistant and form the points of an equilateral triangle. A triangular pattern, a rectangular pattern or any variable pattern suitable for the particular application is feasible to one skilled in the art having the benefits of this disclosure.

Depending on the outside diameter of the ceramic heat exchanger 10 ceramic tubes 60 and the overall ceramic tube 60 length, which has a direct relationship to the outside diameter of the ball seal 70. The minimum centerline to centerline distance between adjacent tubes in the same tube sheet assembly can vary from 2 to 3 times the outside diameter of the ceramic tube.

The design of the tube sheet assembly 51 described in this invention gives the ceramic heat exchanger 10 designer greater flexibility in tube sheet design than ever before. If the heat exchanger application requires a square pattern of ceramic tube 60 centers or some other pattern, then the inner metal structure 52 can be modified and the spacer tubes 56 located accordingly. This in turn will locate the seal assembly 50 and space the ceramic tubes 60 accordingly. So an infinite number of ceramic tube 60 patterns can be designed into the two tube sheet assemblies 51 required in a ceramic heat exchanger 10.

The same design flexibility is possible when selecting the ceramic tube 60 size. If the designer wants to mix ceramic tube 60 sizes in a single ceramic heat exchanger 10, this is also possible. In this case, the spacer tubes 56 in the inner metal structure 56 can be made of different sizes. Then by installing the appropriately sized seal assembly 50 in the respective locations on the two tube sheet assemblies 51, a mixture of two or more ceramic tube 60 diameters can be installed in a single ceramic heat exchanger 10. This design might be used where the larger diameter ceramic tubes 60 are used as a screen wall to protect the smaller ceramic tube 60 from sticky ash particles or extreme radiation from direct flame impingement.

The ceramic heat exchanger 10 tube sheet assembly 51 can be made in any shape to meet the needs of the application. In FIG. 2 and FIG. 3 the tube sheet assembly 51 shown is rectangular. Other tube sheet assembly 51 designs that can utilize the structure taught in this invention are circular, triangular, rectangular or any polygon as long as the two tube sheet assemblies in the same ceramic heat exchanger 10 are identical. As an example, the tube sheet assembly 51 designed to wrap the ceramic tubes around a heat source might result in the tube sheet assembly 51 being "C" shaped or "D" shaped. The wide variety of tube sheet shapes is a key advantage of the ceramic heat exchanger 10 described in this patent application. The tube sheets described in the prior art which are fabricated from stacked ceramic tiles or refractory blocks cannot be made with different size tubes, variable tube spacing or more exotic shapes.

Figure 11:
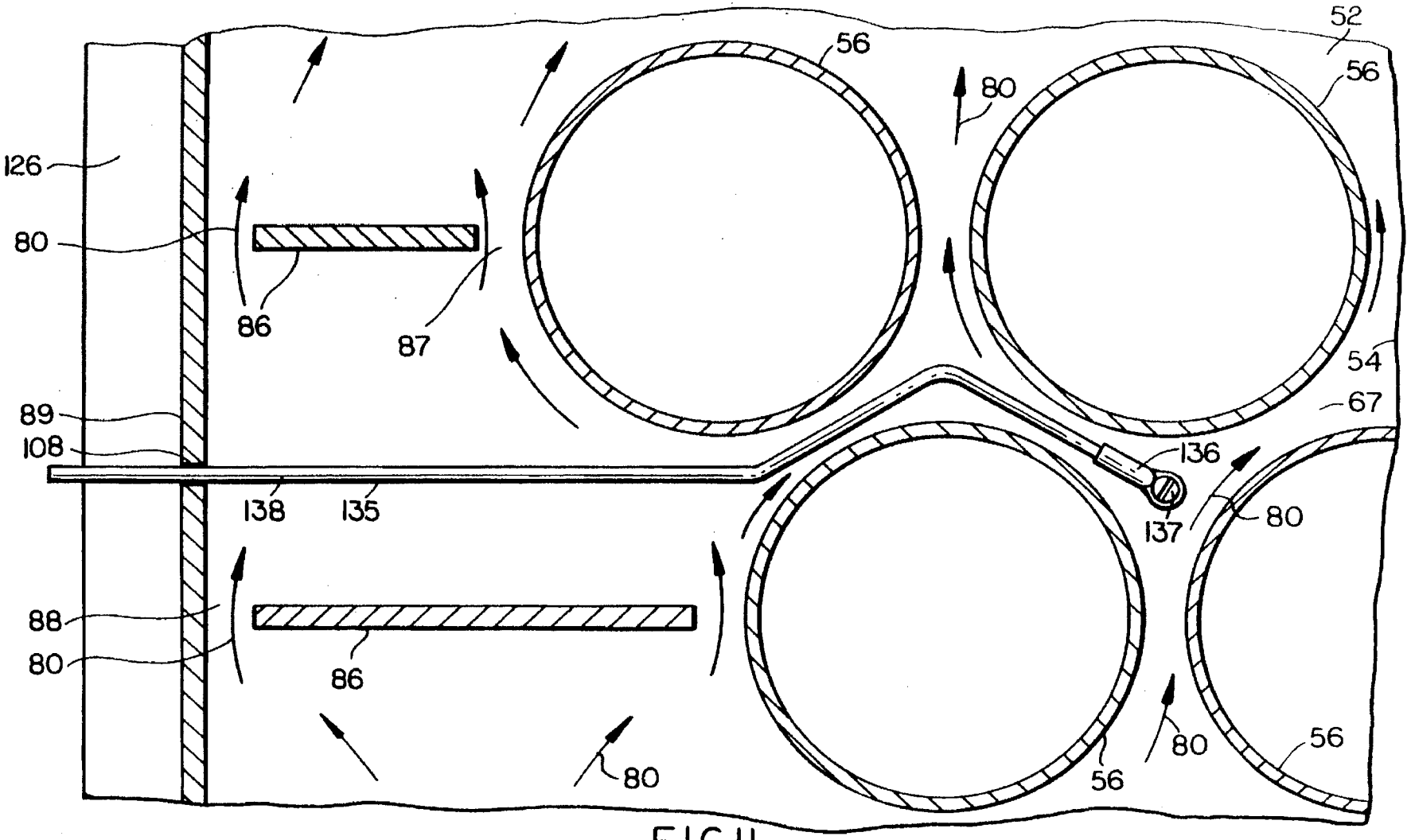
FIG. 11 is a partial sectional view of the cooling duct between the double metal tube sheet walls along section E—E of FIG. 4.

FIG. 11 is a partial cross-section through the inner metal structure 52 of the tube sheet assembly 51 showing the inside surface 67 of the hot side plate 54. The view also shows the spacer tubes 56 at the end of two adjacent ceramic tube 60 rows. Between the spacer tube 56 at the end of each ceramic tube row is a plate 86 attached to the hot side plate 54. The space 87 between the plate 86 and the adjacent spacer tube 56 should be approximately equal to the distance between adjacent spacer tubes 56. The space 88 between the plate 86 and the seal plate 89 should also be approximately equal to the distance between adjacent spacer tubes 56. The length of plate 86 should not exceed 1 to 1.5 times the diameter of the spacer tube and should be installed with a space (not shown) between adjacent plates 86 equal to the space between adjacent spacer tubes 56 if more than on plate 86 is required at the end of a tube row.

The plate 86 is designed to direct the cooling fluid to the space between adjacent spacer tubes 56. If it were not installed, the cooling air would bypass the spacer tubes and flow up the area 90 between the end of a ceramic tube 60 row and the seal plate 89. The arrows 80 show the desired direction of cooling fluid flow within the inner metal structure 52 of the tube sheet assembly 51. The hot side plate 54 extends beyond the seal plate 89 where a surface 126 is provided which will help form a seal with the metal shell 11 of the ceramic heat exchanger 10.

The cooling of the inner metal structure 52 of the tube sheet assembly 51 is key to maintaining the structural integrity of the ceramic heat exchanger 10. A tube sheet internal temperature sensor system 135 can be installed in the inner metal structure 52 to prevent overheating of the tube sheet assembly 51. The internal temperature sensor system 135 consists of one or more high temperature thermocouples 136 mounted to either the hot side plate 54 or to the process side plate 53 using a screw 137. The thermocouples 136 are connected to external instrumentation through the thermocouple wire 138 which passes out of the inner metal structure 52 through a hole 108 in the seal plate 89.

Figure 13:
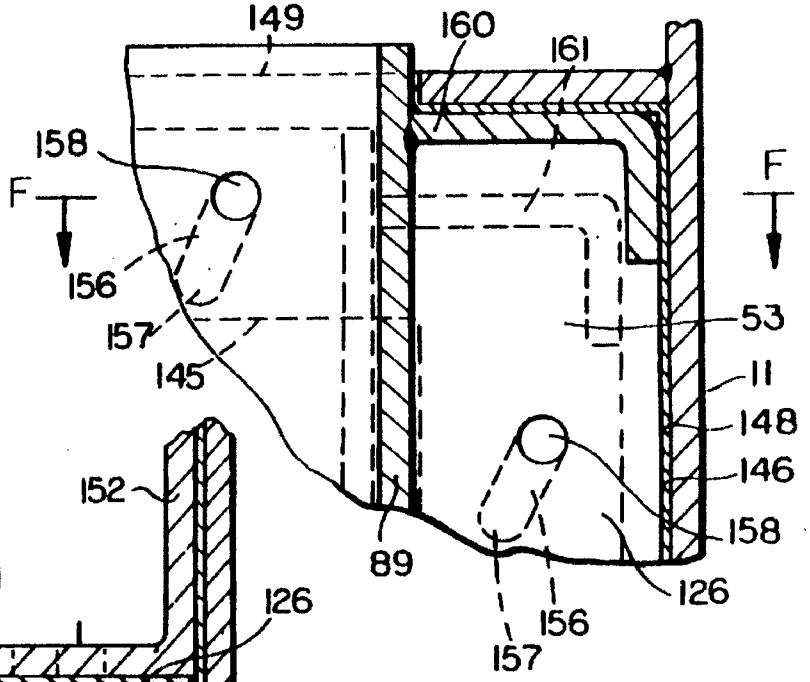
FIG. 13 depicts the mounting details of the right top corner of FIG. 12.
Figure 14:
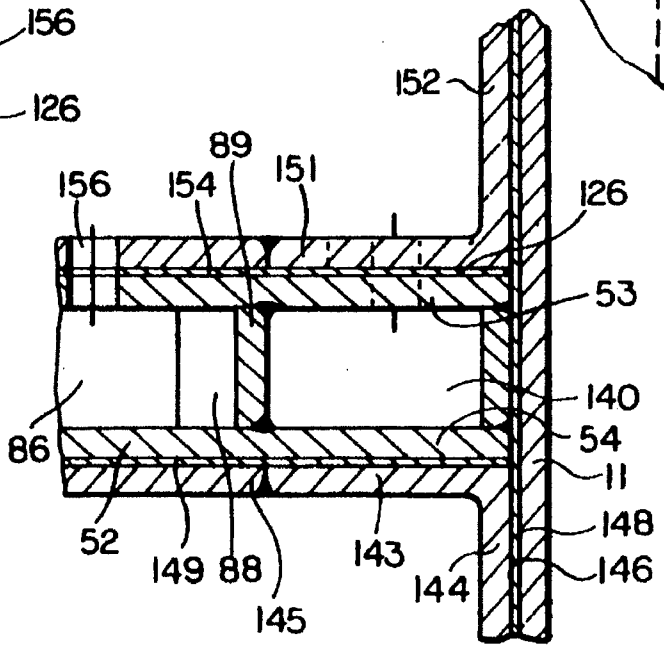
FIG. 14 is a sectional view along section F—F of FIG. 13.
Figure 12:
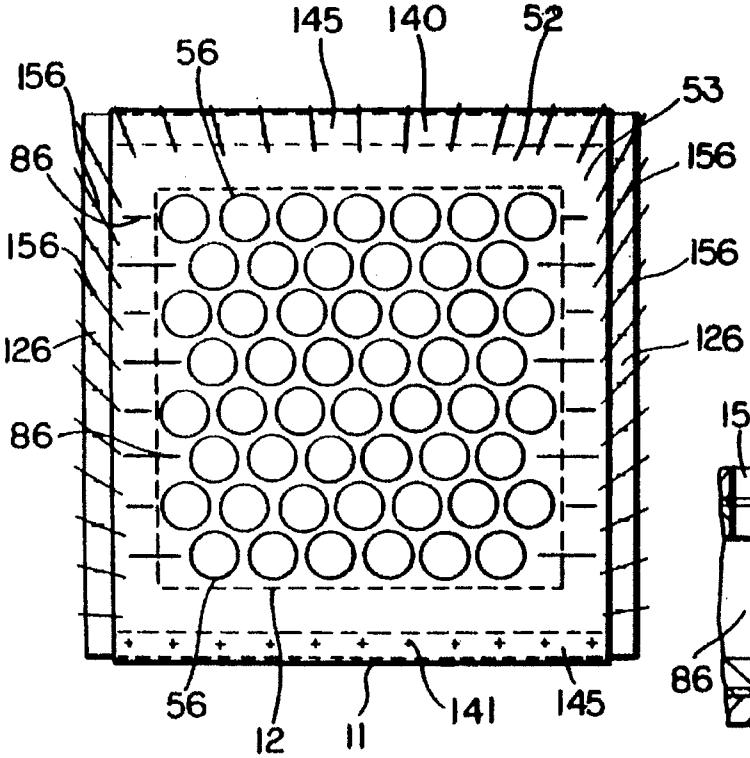
FIG. 12 is a drawing of the mounting details of the double walled metal tube sheet in the ceramic heat exchanger outer casing.

FIGS. 12, 13 and 14 show the special features of the mounting system for the inner metal structure 52 of the tube sheet assembly 51 in the metal shell 11 of the ceramic heat exchanger 10. The inner metal structure 52 must be fully sealed to prevent leakage between the hot gas side and the process gas side at all times, so it must be designed to accommodate the expansion of the tube sheet assembly 51 without breaking the inner metal structure 52 seal with the metal shell 11.

FIG. 12 shows a section through the inner metal structure 52 of the tube sheet assembly 51. The view is looking at the inside surface 66 of the process side plate 53. The spacer tubes 56 and the plates 86 are shown in their respective locations in inner metal structure 52. The refractory lining of the process gas inlet duct 22 is shown in dotted line.

As the ceramic heat exchanger 10 heats up, the tube sheet assemblies 51 will expand perpendicular to the centerline of the ceramic tubes 60 at a faster rate and a larger amount than the metal shell 11. This expansion must be absorbed by the tube sheet mounting system 140. The tube sheet 51 expansion will be almost uniform because of the cooling provided to the inner metal structure 52. The tube sheet assembly 51 will also expand and contract based on the thermal expansion rate of the process side plate 53 and the hot side plate 54 which, as stated before, will be kept at approximately the same temperature.

Since the tube sheet assembly 51 has a uniform expansion rate, it can be designed with a single mounting point 141 attached to a fixed point on the metal shell 11 of the ceramic heat exchanger 10. All of the other moving mounting points 142 will have a radial displacement from the single mounting point 141 as shown in FIG. 12. The single mounting point 141 can be located at any point on the edge of the inner metal structure 52; however, it must be at the same point in the two tube sheet assemblies 51 in a ceramic heat exchanger 10, and there must be radial freedom of motion for the inner metal structure 52 from the single mounting point 141.

FIG. 14 shows the tube sheet assembly 51 mounting details where it attaches to the metal shell 11 of the ceramic heat exchanger 10. On the hot gas side of the inner metal structure 52, is a support frame consisting of a support angle 144, which is attached to the inside surface 146 of the metal shell 11, either by welding or by bolts (not shown). Between the support angle 144 and the metal shell 11 there is a ceramic fiber gasket 148. Across the top and bottom of the tube sheet mounting system 140, there is a slot 149 which provides an opening for the cooling gas to enter or exit from the tube sheet assembly 51. At the top and bottom slot 149 the support angle 144 is replaced with a plate 145 which is welded to the metal shell 11. A ceramic fiber gasket 149 is installed between the support frame 143 and the inner metal structure 52. The inner metal structure 52 is pushed against the support frame 143, but is not attached to the support frame. On process gas side of the inner metal structure 52 is the outer support frame 151 consisting of a support angle 152 which is attached all around the inside surface 146 of the metal shell 11 either by welding or by bolts (not shown). Between the support angle 152 and the metal shell 11 there is a ceramic fiber gasket 148. The outer support frame 151 has a set of radial slots 156 designed to accept bolts (not shown) which are welded to the process side plate 53. When the inner metal structure is cold during installation, the bolts (not shown) are located at the cold end 157 of the slots and when the tube sheet assembly 51 expands during operation the bolts move up the radial slots 156 to the hot end 158. Between the outer support frame 151 and the inner metal structure is a ceramic fiber gasket 154. The hot gas side support frame 143 and the process gas side outer support frame 151 form gas tight seals on both sides of the inner metal structure 52 in both the hot position 160 shown in solid lines in FIG. 13 or the cold position 161 shown in the long dashed lines in FIG. 13. An additional seal is achieved when the inner metal structure 52 has achieved full expansion in the metal shell 11 and pushes into the ceramic fiber gasket 148 which is attached to the inside of the metal shell 11. The refractory liner 12 inside the metal shell 11 on both sides of the tube sheet assembly 51 protects the tube sheet mounting system 140 from the high temperature gases inside the ceramic heat exchanger 10.

The ceramic heat exchanger 10 described herein has solved the problems noted with the prior art. The increased freedom of motion of the ceramic tubes 60 has eliminated the bending stress problems found with current designs. The design of the seal assembly 50 has eliminated the destruction of the tube seal by the expansion and contraction of the ceramic tubes 60 within the ball seal 70. Also the failure of the tube sheet as indicated by excessive leakage through the tile joints has been eliminated by the fabrication of the tube sheet assembly 51 with an inner metal structure 52 which is cooled to maintain the structural integrity. This tube sheet assembly prevents any leakage between the hot gas and the process gas.

With these technical innovations, and new ceramic materials, it is possible to achieve higher operating temperatures than ever before. The ceramic heat exchanger 10 herein described can operate with hot gas temperatures of 1,600° C. where the ceramic heat exchanger 10 transitions to a dual heat transfer mode. The current designs show heat exchangers where the mode of heat transfer is convective. In the case of the new design, the ability to successfully operate at higher temperatures allows the ceramic heat exchanger 10 to transfer heat through both convective heat transfer and radiant heat transfer. At 1,600° C. the radiant component approaches 25 percent of the total heat transferred from the hot gas to the process gas.

The ceramic tubes 60 in the ceramic heat exchanger can be made with extended surfaces (not shown) in the future. The extended surfaces can be external fins or highly textured surfaces on the ceramic tubes 60. On the internal surface of the ceramic tubes 60 the extended surface can be an internal fin, a highly textured surface, or an insert pushed into the tube which has close contact with the inside surface of the ceramic tube 60. The extended surfaces improve convective and radiant heat transfer of the ceramic heat exchanger 10.

For purposes of this description, the design of the ceramic heat exchanger 10 shows the hot gas side to be the shell side while the process gas passes through the ceramic tubes 60. The ceramic heat exchanger 10 will also successfully operate with the process gas on the shell side while the hot gas passes through the ceramic tubes.

Figure 15:
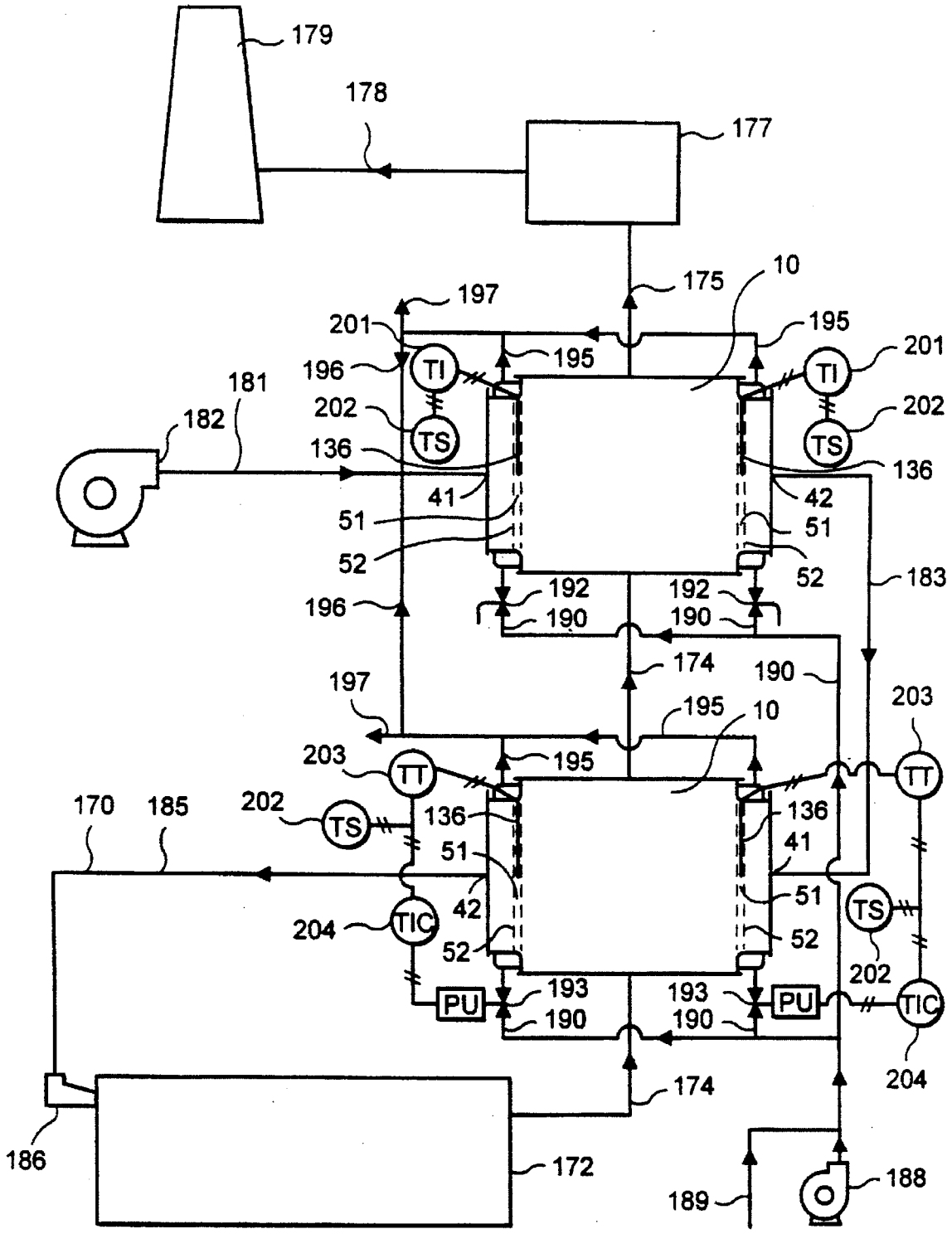
FIG. 15 is a schematic of the process where the ceramic heat exchanger provides heat recovery for a high temperature furnace.

The ceramic heat exchanger 10 is an important element in a high temperature heat recovery system 170 shown in FIG. 15. The high temperature heat recovery system 170 is designed to improve the energy efficiency and reduce the environmental impact of any high temperature furnace 172. High temperature furnaces 172 are found in the metal smelting, glass, refining, chemical, and waste incineration industries. Specific applications include steel remelting, refinery heaters and carbon black furnaces. In all these systems a high temperature furnace 172 has an exhaust gas stream 174 which exits at a temperature ranging between 900° to 1,500° C. Heat can be recovered from this exhaust gas stream which can be returned to the process which will reduce the use of fuel. Downstream of the high temperature furnace 172, one or more ceramic heat exchangers 10 can be mounted in the hot gas stream 174. The ceramic heat exchangers 10 can be mounted in parallel or in series (as shown in FIG. 15) or both. The gas stream 175 exits the ceramic heat exchanger 10 at a temperature ranging between 250° to 550° C. having returned some heat to the process gas and enters the environmental cleaning system 177, where the products of combustion are cleaned of hazardous materials. The clean gas stream 178 then is vented to the system stack 179.

The heat which was recovered from the exhaust gas stream 174 is transferred to the process gas stream 181. A process gas fan 182 sends the process gas stream 181, which can be at temperatures ranging from ambient to 450° C., to the process gas inlet 41 of the first ceramic heat exchanger 10. The process gas 181 absorbs approximately half of the available heat in the exhaust gas stream 174 (if two heat exchangers are used as shown) and exits the ceramic heat exchanger 10 at the process gas outlet 42. The partially heated process gas 183 continues on to the process gas inlet 41 of the second ceramic heat exchanger 10 where the partially heated process gas 183 absorbs the remaining heat from the exhaust gas stream 174. The fully heated process gas 185 exits the ceramic heat exchanger 10 at the process gas outlet 42 at a temperature ranging between 500° to 1,100° C., where it proceeds to the burners 186 mounted on the high temperature furnaces 172. The high temperature heat recovery system 170 can recover up to 50 percent of total heat required by the high temperature furnace 172 using the ceramic heat exchanger 10 described in this invention. The 50 percent reduction in the hazardous chemical composition of the flue gas stream which reduces the environmental impact.

In addition to the exhaust gas stream 174 and process gas stream 181 flow, the ceramic heat exchangers 10 require that a coolant be pumped through the inner metal structure 52 of each tube sheet assembly 51. Referring to FIG. 15 a cooling fan 188 or in the case of steam, a steam supply 189 provides cooling fluid through an inlet duct 190 to each of the tube sheet assemblies 51 on the two ceramic heat exchangers 10. On the inlet duct 190 to each tube sheet assembly there is either a manual control valve 192 or a motorized control valve 193.

The cooling fluid picks up the excess heat from the tube sheet assembly 51 and exits the two ceramic heat exchangers 10 through outlet duct 195. If the coolant is air or the same as the process gas, then the outlet duct 195 can vent the cooling fluid to the process gas stream 181 through vent ducts 196. If the coolant is not compatible with the process gas, then the cooling fluid can be vented from the outlet duct 195 through the coolant vents 197.

As described earlier, it is possible to install one or more thermocouples 136 in each of the inner metal structures 52 of the tube sheet assembly 51. The thermocouple 136 signal can be sent to a temperature indicator 201 which can give the operator an indication of the inner metal structure 52 temperature, to enable the operator to set the manually control valves 192 to the correct position, so that the cooling fluid can maintain the proper temperature in the inner metal structure 52. Along with the temperature indicator 201, there can also be a temperature switch 202 which can operate as a process interlock and shut down the process if the temperature in the inner metal structure 52 exceeds safe limits.

In a more sophisticated process or in a process where the valves for the tube sheet coolant are remote, a control system can be installed. The thermocouple 136 signal can be sent to a temperature transmitter 203 and then on to a temperature indicating controller 204. The operator can set the temperature to be maintained in the inner metal structure 52 and the temperature indicating controller 204 will send the proper signal to the motorized control valve 192 to maintain the proper inner metal structure 52 temperature.

The description of the preferred embodiment described herein is not intended to limit the scope of the invention which is properly set out in the claims.

What is claimed is:

1. A ceramic heat exchanger for a heat recovery system comprising:

a shell having a first tube sheet at a first end and a second tube sheet at a second end;

at least one ceramic heat exchanger tube disposed between said first tube sheet and said second tube sheet, said ceramic heat exchanger tube mounted into seal assembly means on each of said tube sheets; and each of said seal assembly means allowing for both axial tube expansion and contraction as well as angular freedom of motion to prevent the development of a moment force on said ceramic heat exchanger tube.

2. A method of using the ceramic heat exchanger of claim 1, wherein said heat exchanger operates in the temperature range of about 900° C. to about 1600° C., and wherein heat transfer is achieved by a combination of convective means and radiant means.

3. A ceramic heat exchanger for a heat recovery system, comprising:

a shell having a first tube sheet at a first end and a second tube sheet at a second end;

at least one ceramic heat exchanger tube disposed between said first tube sheet and said second tube sheet, said ceramic heat exchanger tube mounted into seal assemblies on said tube sheets; and each of said seal assemblies comprising a ball seal mounted in said tube sheets, said ball seal for allowing tube expansion and contraction without displacing said tube sheets, said ball seal having a radius of curvature centered from the centerline of said ceramic heat exchanger tube in two planes which allows an angular freedom of motion for said ceramic heat exchanger tube.

4. The ceramic heat exchanger of claim 3, wherein said shell is a refractory lined shell having disposed between said first tube sheet and said second tube sheet, a plurality of ceramic heat exchanger tubes.

5. The ceramic heat exchanger of claim 3, wherein said ball seal is mounted in each said tube sheets by a first tile piece and a second tile piece, said first tile piece being a tube side tile and said second tile piece being a process side tile, said first and second tiles joined at a junction which retains the ball seal and has a slightly larger radius in two planes than the radius of said ball seal.

6. The ceramic heat exchanger of claim 3, wherein said ball seal has a first radius and is mounted in each said tube sheets by a first tile piece and a second tile piece, said first tile piece being a tube side tile and said second tile piece being a process side tile;

said first and second tile pieces joined at a junction, said junction having a curved surface, said curved surface having a second radius in the transverse plane which is greater than said first radius of said ball seal, and said curved surface having a third radius in the longitudinal plane which is greater than said first radius of said ball seal; and each radius formed at an offset to cause the longitudinal curve of said first and second tile pieces to approach the surface of said ball seal at each end of said curved surface of said junction.

7. The ceramic heat exchanger of claim 3, wherein said junction having a curved surface is filled with ceramic fiber to form a seal and to act as a cushion for said ball seal.

8. The ceramic heat exchanger of claim 5, wherein each of said tube sheets is comprised of two parallel metal wall plates having two sides, said two sides each having disposed thereon a refractory material, said parallel wall plates having disposed therebetween a metal tubing which is concentric to the centerline of said ceramic heat exchanger tube.

9. The ceramic heat exchanger of claim 3, wherein each of said tube sheets is comprised of two parallel metal wall plates having two sides, said two sides each having disposed thereon a refractory material, said parallel wall plates Joined by a metal tubing, said tubing concentric to the centerline of said ceramic heat exchanger tube; and said tube side tile and said process side tile each having a flange which overlaps said refractory material disposed on said two sides of said parallel plates.

10. The ceramic heat exchanger of claim 8, wherein said tubing disposed between said two parallel wall plates, forms a cooling duct thereby for pumping a cooling gas therethrough.

11. The ceramic heat exchanger of claim 8, wherein the location of said centerline of said ceramic heat exchanger tube within said tube sheets forms a triangular pattern or a rectangular pattern.

12. The ceramic heat exchanger of claim 8, wherein said tube sheets can be circular, triangular, rectangular or polygonal in shape.

13. The ceramic heat exchanger of claim 10, wherein each of said tube sheets is comprised of said parallel wall plates joined by said metal tubing, said tubing concentric to said centerline of said ceramic heat exchanger tube; and spacer plates disposed at the end of rows comprised of said at least one ceramic heat exchanger tube, said spacer plates for providing an even coolant flow between said parallel wall plates.

14. The ceramic heat exchanger of claim 10, wherein said parallel wall plates have at least one thermocouple means disposed in a cooling duct formed therebetween.

15. The ceramic heat exchanger of claim 10, wherein each of said tube sheets has a single fixed mounting point in said shell and at least one movable mount means for allowing expansion in a radial direction from said fixed mounting point.

16. The ceramic heat exchanger of claim 10, wherein each of said tube sheets has full seal contact with said shell during any deflection due to thermal expansion and contraction.

17. A ceramic heat exchanger for a heat recovery system, comprising:

a shell having a refractory lining, said shell having a first tube sheet assembly at a first end and a second tube sheet assembly at a substantially opposing end;

each said tube sheet assemblies comprising a hot side plate and a process side plate, said hot side plate and said process side plate being substantially parallel to each other and having therebetween a hollow spacing means;

at least one ceramic heat exchanger tube mounted between said first tube sheet assembly and said second tube sheet assembly, each said ceramic heat exchanger tube having a centerline, said hollow spacing means between said parallel plates of said tube sheets being concentric to said centerline; and at least two ball seals holding said at least one ceramic heat exchanger tube in said tube sheet assemblies, each said ball seal having a radius of curvature centered from said centerline of each said ceramic heat exchanger tube in two planes which allows an angular freedom of motion for said ceramic heat exchanger tube.

18. The ceramic heat exchanger of claim 17, wherein said shell has a hot gas inlet and a hot gas outlet between said tube sheet assemblies, each said tube sheet assemblies comprised of parallel steel plates having a refractory material coating on both sides, said hollow spacing means disposed between said parallel plates for passing a cooling gas therethrough, and a process gas inlet and outlet chamber on each end outside each said tube sheet assembly.

19. The ceramic heat exchanger of claim 18, wherein said shell has a process gas inlet and a process gas outlet between said tube sheets assemblies, each said tube sheet assemblies comprised of parallel steel plates having a refractory material coating on both sides, said hollow spacing means disposed between said parallel plates for passing a cooling gas therethrough, and a hot gas inlet and a hot gas outlet chamber on each end outside each said tube sheet assembly.

20. A method of using the ceramic heat exchanger of claim 19, wherein said cooling gas can be ambient air, or steam at about 100° to about 150° C.

21. The ceramic heat exchanger of claim 19, wherein said ball seal is held in each said tube sheet assembly between a hot face tile and a cold face tile, and a refractory material is cast on the surfaces of said hot face tile and said cold face tile.

22. The ceramic heat exchanger of claim 19, wherein the ratio of thickness of said refractory material cast on the surface of said hot face tile to the thickness of said refractory material cast on the surface of said cold face tile is adjusted to the same ratio as the hot side temperature and cold side temperature above the cooled temperature of said tube sheet assembly.

23. The ceramic heat exchanger of claim 22, wherein said cold face tile has a hexagonal shaped opening on centerline to allow a matching tool means to engage threads on said cold face tile into threads on said hot face tile.

24. The ceramic heat exchanger of claim 22, wherein the outside diameter of said ceramic heat exchanger tube is ground to a diameter which allows a slip fit with the inside diameter of said ball seal.

25. The ceramic heat exchanger of claim 22, wherein each of said ceramic heat exchanger tubes is independently removable.

26. The ceramic heat exchanger of claim 22, wherein each of said ceramic heat exchanger tubes can be plugged in the event of a failure of said ceramic heat exchanger tubes.

27. The ceramic heat exchanger of claim 22, wherein said tube sheet assemblies can accommodate two or more ceramic heat exchanger tube sizes.

28. The ceramic heat exchanger of claim 22, wherein said tube sheet assemblies can accommodate said heat exchanger tubes having centerline spacing between adjacent tubes of two to three times the outside diameter of an exchanger tube.

* * * * *